US010119319B2

(12) United States Patent
Ritt

(10) Patent No.: US 10,119,319 B2
(45) Date of Patent: Nov. 6, 2018

(54) DOOR DRIVE DEVICE FOR A DOOR OF A WAGON

(71) Applicant: Vapor Europe S.r.l., A Wabtec Company, Sassuolo (MO) (IT)

(72) Inventor: Alois Ritt, Amstetten (AT)

(73) Assignee: Vapor Europe S.r.l., Sassuolo (MO) (IT)

( * ) Notice: Subject to any disclaimer, the term of this patent is extended or adjusted under 35 U.S.C. 154(b) by 0 days.

(21) Appl. No.: 15/108,659

(22) PCT Filed: Dec. 24, 2014

(86) PCT No.: PCT/EP2014/079303
§ 371 (c)(1),
(2) Date: Jun. 28, 2016

(87) PCT Pub. No.: WO2015/101580
PCT Pub. Date: Jul. 9, 2015

(65) Prior Publication Data

US 2016/0319583 A1 Nov. 3, 2016

(30) Foreign Application Priority Data

Dec. 30, 2013 (EP) ..... 13199847

(51) Int. Cl.
*E05F 15/652* (2015.01)
*B61D 19/02* (2006.01)
*E05F 15/655* (2015.01)

(52) U.S. Cl.
CPC ..... *E05F 15/652* (2015.01); *B61D 19/02* (2013.01); *E05F 15/655* (2015.01); *E05Y 2201/696* (2013.01); *E05Y 2900/51* (2013.01)

(58) Field of Classification Search
CPC .. E05Y 2900/51; E05F 15/652; E05F 15/565; E05F 15/655; E05F 17/004; E05D 2015/1055; E05D 15/1068; B61D 19/02
See application file for complete search history.

(56) References Cited

U.S. PATENT DOCUMENTS 4,409,905 A * 10/1983 Zerbi ..... B61B 12/002 105/149.1
5,207,024 A 5/1993 Epema et al.
(Continued)

FOREIGN PATENT DOCUMENTS

CA 2235877 A1 10/1998
CN 1344633 A 4/2002
(Continued)

*Primary Examiner* — Justin B Rephann
(74) *Attorney, Agent, or Firm* — The Webb Law Firm

(57) ABSTRACT

A door drive device for a door of a wagon, including at least one door panel mount displaceable along a first spatial axis substantially vertical to the plane of a door panel mounted on the at least one door panel mount and along a second spatial axis extending substantially horizontal in use and substantially vertical to the first spatial axis, a drive motor and a spindle which may be rotated by means of the drive motor. It is provided, that a displacement of the at least one door panel mount along the first and/or second spatial axis is effected by means of a guide fork being displaceable by an associated spindle nut slidably engaged with the guide fork, wherein the spindle nut is driven by rotation of a spindle and wherein the spindle and the drive motor are fixed with respect to the wagon.

19 Claims, 5 Drawing Sheets

(56) References Cited

U.S. PATENT DOCUMENTS 5,253,452 A * 10/1993 Goldbach ..... B60J 5/062 49/128
5,263,280 A * 11/1993 Dilcher ..... B61D 19/009 49/212
5,483,769 A * 1/1996 Zweili ..... B61D 19/008 49/118
5,826,377 A * 10/1998 Simson ..... E05D 15/0656 49/362
5,893,236 A * 4/1999 Krbec ..... B61D 19/008 49/118
6,009,668 A * 1/2000 Reddy ..... E05C 3/34 49/280
6,282,970 B1 * 9/2001 Oakley ..... E05F 15/652 49/362
6,385,910 B1 5/2002 Smink et al.
6,446,389 B1 * 9/2002 Heffner ..... B61D 19/02 49/118
6,539,669 B1 * 4/2003 Heidrich ..... B61D 19/008 16/87 R
6,684,567 B2 * 2/2004 Heidrich ..... B61D 19/008 49/213
6,718,694 B2 * 4/2004 Stojc ..... F16H 25/24 49/118
8,661,732 B2 * 3/2014 Kong ..... E05B 81/00 49/116
8,661,733 B2 * 3/2014 Lee ..... E05B 47/0012 49/116
2002/0092236 A1 7/2002 Heffner et al.
2008/0190151 A1 8/2008 Ritt et al.
2012/0073208 A1 * 3/2012 Lee ..... E05F 15/652 49/449
2016/0046176 A1 * 2/2016 Prevost ..... E05D 15/1068 105/343

FOREIGN PATENT DOCUMENTS

CN 202429208 U 9/2012
CN 202559954 U 11/2012
DE 511580 C 11/1930
DE 4241560 A1 6/1994
DE 202005007984 U1 11/2006
EP 0465281 A1 1/1992
EP 0492743 A1 7/1992
EP 0820889 A1 1/1998
EP 0875434 A1 11/1998
EP 1527975 A1 5/2005
EP 1710381 A1 10/2006
EP 1767388 A2 3/2007
EP 2287428 A2 2/2011
GB 2391040 A 1/2004
WO 2005103429 A2 11/2005

* cited by examiner

DOOR DRIVE DEVICE FOR A DOOR OF A WAGON

CROSS-REFERENCE TO RELATED APPLICATIONS

This application is the United States national phase of International Application No. PCT/EP2014/079303 filed Dec. 24, 2014, and claims priority to European Patent Application No. 13199847.8 filed Dec. 30, 2013, the disclosures of which are hereby incorporated in their entirety by reference.

BACKGROUND OF THE INVENTION

Field of the Invention

The invention relates to a door drive device, to a door and to a wagon.

Description of Related Art

Sliding plug doors are often deployed in mass transportation vehicles. In a closed state, door panels of such doors are located within the vehicle wall, wherein in an opened state the door panels are located on top of the vehicle wall adjacent to the door opening. To bring a sliding plug door from a closed state in an opened state, the door panels first have to be moved outside the vehicle wall, i.e. mostly vertical to a longitudinal axis of the vehicle. Secondly, the door panels have to be shifted sideways in order to clear the door opening. To bring the sliding plug door from the opened state back into the closed state, the same movements have to be performed in opposite direction and in opposite order.

Door drive devices or actuators are necessary to carry out said movements of the door panels of sliding plug doors. Therein, a drive motor for driving the sideward movement of the door panels may either be fixed with respect to the vehicle, i.e. on the vehicle wall, or be mounted on a part which moves in and out of the vehicle wall together with the door panels.

If the motor is fixed with respect to the vehicle, the output force of the motor has to be transmitted to the door panels by means of a flexible joint. As a result, door drive devices with such a transmission of the output force of the drive motor tend to be heavy, to occupy much space and to require a high cost of production when compared to other door drive devices.

However, a drive motor which is displaceable with respect to the vehicle or is mounted on a movable part requires a moving supply cable being disadvantageous in terms of reliability and cost of production. Another disadvantage of such door drive devices is that due to the heavy drive motor and corresponding drive mechanism a huge mass has to be moved out and back in together with the door panels, what is slowing down the opening and closing procedure of the sliding plug door. Such a door drive device is e.g. disclosed in EP 0 820 889 A1. Therein, sleeves connected to door panels are guided by carrying shafts and displaced by means of a spindle mechanism driven by a motor. Both the spindle mechanism and the motor are being moved out of and into the vehicle wall together with the door panels. Therefore the known door drive device requires relatively much installation space.

An object of the invention is to provide a door drive device which is reduced in weight and production cost compared to known door drive devices and requires less mass to be moved out and back in the vehicle wall during the opening and closing procedures of the door.

The object of the invention is to provide a door drive device which is reduced in weight and production cost compared to known door drive devices and requires less mass to be moved out and back in the vehicle wall during the opening and closing procedures of the door.

SUMMARY OF THE INVENTION

Such a door drive device for a door of a wagon comprises at least one door panel mount displaceable along a first spatial axis substantially vertical to the plane of a door panel mounted on the at least one door panel mount and along a second spatial axis substantially vertical to the first spatial axis and extending substantially horizontally, when the door panel is in use. The door drive device further comprises a drive motor or drive motor unit for driving the displacement of the door panel mount and for effecting a rotary motion of a spindle. It is provided that a displacement of the at least one door panel mount along the first and/or second spatial direction is effected by means of a guide fork driven by an associated spindle nut, wherein the spindle nut is slidably engaged by the guide fork and engages the spindle such that it may be driven by a rotation of the spindle. Therein, both the spindle and the drive motor are fixed with respect to the wagon, i.e. the spindle and the drive motor and are not being displaced along the first and/or second spatial axis with respect to the wagon while the door is opened or closed.

Since the drive motor and the spindle do not have to be displaced with respect to the wagon, the sum of the masses of all components which have to be moved along the first spatial axis during an opening and closing procedure of the door may be small compared to known door drive devices. As a result, the time needed for the opening and closing procedure may be reduced.

Such a door drive device may be composed of simpler components compared to the prior art because no flexible supply cable for the drive motor and no flexible joint to transmit the output force of the drive motor are necessary. It may also require less installation space since no space for said flexible parts is needed. Therefore, such a door drive device may require lower production costs and may weigh less. Furthermore, the door drive device may be more reliable and may require less maintenance than known devices, since no flexible supply cables and/or flexible joints are necessary which are bent and stressed in every opening and closing procedure of the door and can thus be subject to wear.

In particular, the door drive device may be used to drive sliding plug doors. But the door drive device may also be applied in sliding doors in general.

The slidable engagement of the guide fork with the spindle nut prevents a rotation of the spindle nut when the spindle is rotated. A rotation of the spindle thus results in a displacement of the spindle nut along the longitudinal extension of the spindle, which may be aligned with the second spatial direction.

On the one hand, the guide fork may be directly attached to the door panel mount. A displacement of the spindle nut and therewith a displacement of the guide fork along the second spatial direction results in a displacement of the door panel mount substantially in the same direction, wherein the distance covered by the spindle nut approximately equals the distance covered by the door panel mount and thus the door panel. The door panel mount may be slidably attached to and guided by an elongate guide rail substantially extending along the second spatial axis.

On the other hand, the door drive device may comprise at least one drive carriage to which the guide fork may be attached. The drive carriage may connect the door panel mount with the guide rail and be slidably attached to and guided by the guide rail, wherein the door panel mount is slidably attached to the drive carriage. Furthermore, a mechanism may be provided, causing a relative displacement between the drive carriage and the door panel mount upon a relative displacement between the drive carriage and the guide rail. Said displacements may be carried out along the first and/or second spatial axis, particularly along the second spatial axis.

At least one pinion may be rotatably fixed on the at least one drive carriage and engage both a gear rack of the guide rail and a gear rack of that door panel mount which is associated to the at least one drive carriage. This arrangement may cause a relative movement between the door panel mount and the dive carriage when the drive carriage is moved relative to the guide rail or another part which is not displaceable along the second special axis with respect to the wagon. In particular, a displacement of the at least one guide fork substantially along the second spatial axis over a specific distance may result in a displacement of the associated door panel mount in substantially the same direction and substantially over the double of said distance (both with respect to e.g. the guide rail or the wagon). As a result, the spindle may be designed shorter, e.g. only of a length substantially corresponding to half the width of the door opening. The door drive device may then require less installation space.

The door drive device may be used for doors having a single door panel. Then also only one door panel mount, spindle nut, drive carriage, guide fork and corresponding other parts may be necessary. Alternatively, for driving two door panels, the door drive device may comprise each two door panel mounts, drive carriages, guide forks, spindle nuts and other corresponding parts. Therein, both parts of each pair may be displaceable in the second spatial axis simultaneously but in opposite direction. Then the two door panels move away from each other when the door is being opened and move towards each other when the door is being closed.

To allow for this movement of the two door panels and their associated door panel mounts, drive carriages, guide forks and spindle nuts, the spindle may be provided with two portions having a threaded surface each, wherein the threads of the two portions are of opposite sense of rotation. The inclination of the threads of both portions of the spindle may be identical. In this case both door panels may slide sideways at the same speed and may open the door frame symmetrically. The inclination of the threads may also be different. Then the two door panels may by shifted sideways at different speeds and may travel a different distance in the same time. The spindle nuts may have inner threads corresponding to the outer threads of the portions of the spindle. In particular one spindle nut may be used in correspondence with each one door panel mount but also two or more spindle nuts may be applied in correspondence with each door panel mount, e.g. for an increased stability. Each spindle nut may be operatively connected to one or more guide forks.

The guide fork may be designed such or mounted within the door drive device (in particular to the door panel mount or to the drive carriage) such that it is either pivotable or that it is not pivotable, in particular about a pivot axis being substantially parallel to the axis of rotation of the spindle.

The guide rail of the door drive device may be guided along the first spatial axis (i.e. in both directions on this axis) by corresponding guide means. The guide rail may be of an elongate form extending along the second spatial axis and having two ends. Guide means to guide the guide rail may likewise be designed as rails on which corresponding portions on the ends of the guide rail may be guided. The guide means may e.g. be designed as roller guiding, linear guiding or recirculating ball bearing guide which may have a main body (holding the rollers) having an inside and/or outside surface with a cross section having a substantially rectangular, polygonal or C-shaped form. The drive motor or another device (which may form a drive unit together with the drive motor) may effect the movement of the guide rail along the first spatial axis.

The at least one guide fork may have an upper portion which slidably engages in an upper recess of the associated spindle nut and a lower portion which slidably engages in a lower recess of the associated spindle nut. Like this the guide fork may hold the spindle nut. The spindle nut may not be displaceable along the first spatial axis while the at least one guide fork may be slidably displaceable in the first spatial axis with respect to the associated spindle nut. The upper and lower portions may be aligned substantially in parallel to one another and be slidably (along their longitudinal extension) connected with the spindle nut. Moreover, the upper and lower portions of the guide fork may be designed elongate extending at least partially along the first spatial axis and be connected with each other on one side of the spindle and not be connected with each other on the other side of the spindle. When mounting the door drive device, the guide fork may therefore simply be plugged on the spindle nut. Therefore, the spindle nut may be designed as a single part being robust and allowing for an easy and quick mounting of the door drive device. Alternatively, the upper and lower portions of the guide fork may also be connected to one another on both sides of the spindle (and the spindle nut), forming an elongate loop.

The upper and lower portions of the guide fork may either extend substantially along the first spatial axis and thus substantially perpendicular to the spindle or extend at an oblique angle with respect to the spindle, either within or not within the plane spanned by the first and second spatial axis.

A displacement of the at least one door panel mount along the first (and/or second) spatial axis may at least partially be effected by means of the guide fork, in particular by means of a guide fork, extending at an oblique angle with respect to the spindle.

A displacement of the at least one door panel mount along the first spatial axis may be effected by a displacement of the guide rail along the first spatial axis. For door drive devices with e.g. two door panel mounts, each one for mounting one or more door panels, both door panel mounts may be displaced together along the first spatial axis by displacing the guide rail along said axis.

According to another aspect of the invention, a door is provided, comprising a door drive device according to any embodiment and aspect described herein as well as to any combination of aspects and/or embodiments described herein and at least one door panel.

According to another aspect of the invention, a wagon is provided, comprising at least one door according to any embodiment or aspect described herein as well as to any combination of aspects and/or embodiments described herein.

BRIEF DESCRIPTION OF THE DRAWINGS

Additional features and aspects of the invention will be explained in more detail in the following description of exemplary embodiments with reference to the accompanying figures, wherein.

DETAILED DESCRIPTION OF THE INVENTION

Figure 1:
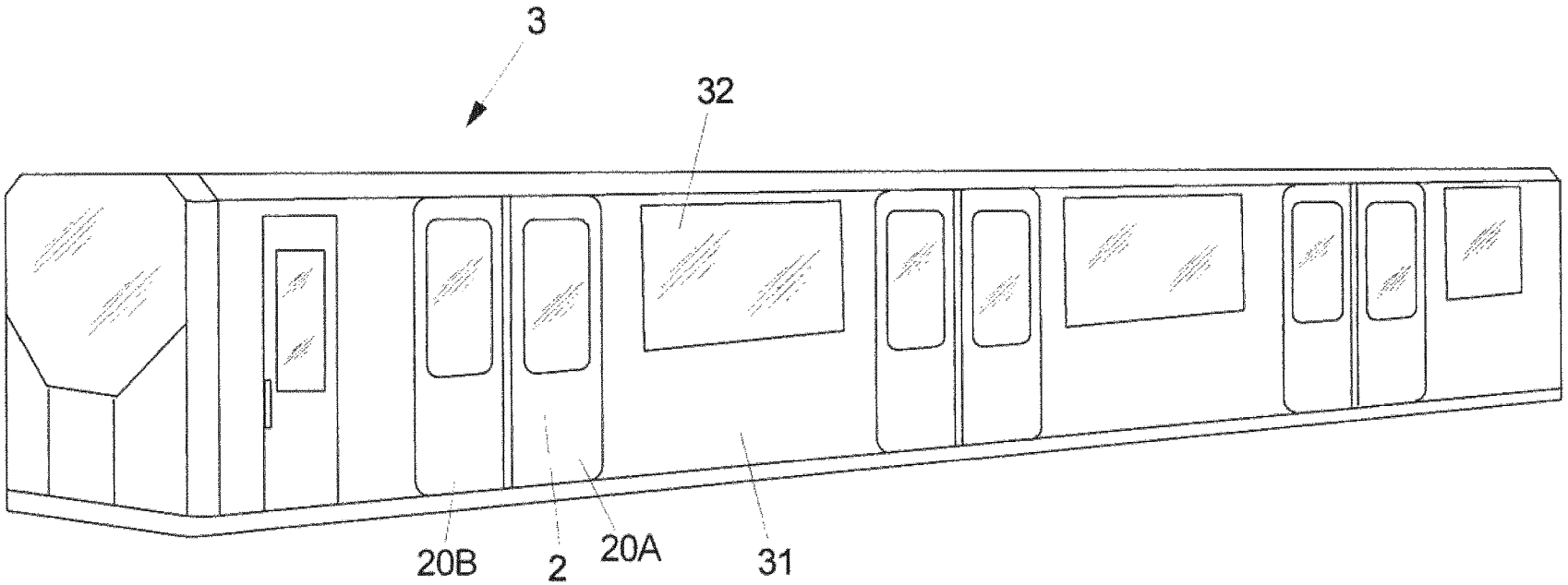
FIG. 1 shows a wagon of a mass transportation vehicle.

FIG. 1 shows a wagon 3 of a mass transportation vehicle comprising a wagon body 31, wagon windows 32 and several doors 2. Each door 2 comprises two door panels 20A, 20B. To open and close the door panels 20A, 20B, the doors 2 are equipped with door drive devices 1 (not shown in FIG. 1). The door drive devices 1 will be described in more detail with reference to the following figures.

The wagon 3 of FIG. 1 is a wagon 3 of a mass transportation vehicle, in particular of a metro train, and serves as an example for all other mass transportation vehicles, such as railway trains, busses, airplanes, cable cars, street cars, and others.

Mass transportation vehicles, such as the mass transportation vehicle having a wagon 3 as shown in FIG. 1, are boarded and alighted through doors. Mostly, sliding plug doors are used for such vehicles, such as the doors 2 shown in FIG. 1.

When being in a closed position, as shown in FIG. 1, sliding plug doors of mass transportation vehicle wagons, as the doors 2 in FIG. 1, do not or only slightly project from the side surface of the wagon body 31. When the door panels 20A, 20B are moved in an opened position, this movement may be mainly divided in two components: first the door panels 20A, 20B are moved outwards, i.e. in a direction substantially vertical to the surfaces of the door panels 20A, 20B. Then, the door panels 20A, 20B are shifted sideways in an opened position to clear the doorframe. When the door panels 20A, 20B are being closed, they are moved back from an opened position into a closed position, wherein the same movements are executed, just in reversed order and direction. The two components of the movement of the door panels 20A, 20B may either be executed one after another or at least party superimposed.

There are wagons that only comprise one door 2. However, usually, wagons 3 of mass transportation vehicles comprise more than one door 2. For example, a wagon 3 may comprise two, three, four or more doors 2 on either side of the wagon 3. Often, doors of wagons of mass transportation vehicles are constructed as double doors, such as or similar to the doors 2 shown in FIG. 1. Eventually, the wagons may comprise one or more additional doors for a driver. In some wagons, there are also doors inside the wagon. In some types of mass transportation vehicles, one or more doors connect each two wagons of the vehicles. For all such doors, doors 2 equipped with a door drive device 1 may be used.

Figure 2:
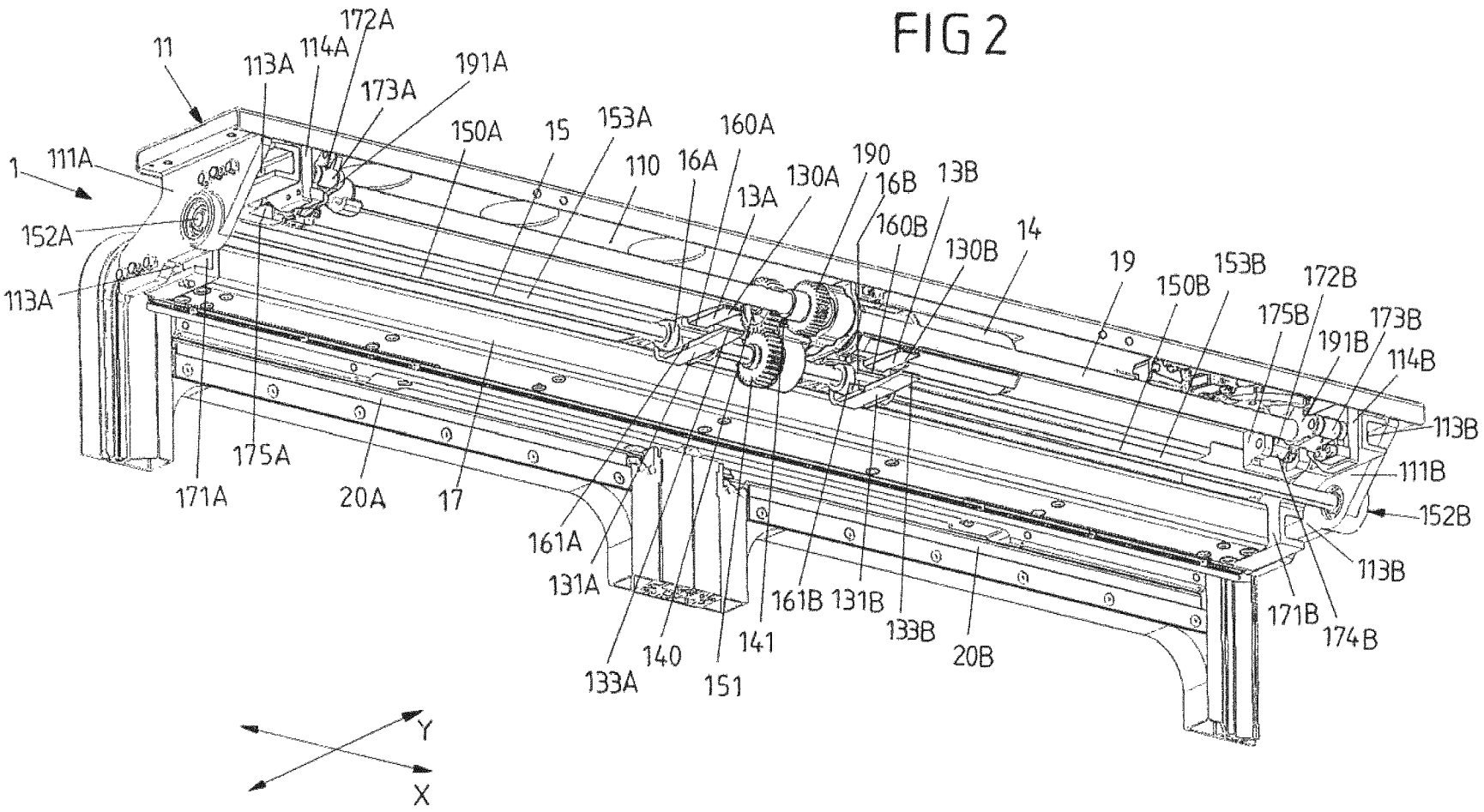
FIG. 2 shows the door drive device together with upper parts of two door panels connected with the door drive device in a closed state.

FIG. 2 shows the door drive device 1 together with upper parts of two door panels 20A, 20B as seen from the inside of a wagon 3. In FIG. 2, the door drive device 1 and the door panels 20A, 20B are shown in a closed state of the door 2.

The door drive device 1 includes a support frame 11 fixable to the wagon 3 and carrying other components of the door drive device 1. The support frame 11 comprises a top panel 110, two side panels 111A, 111B and a cover 112 (not shown in FIG. 2). The top panel 110 carries a drive motor 14, which is connected to a spindle 15 and a rod 19 by means of pinions 140, 151 and pinions 141, 190, respectively. The spindle 15 extends between both side panels 111A, 111B and is rotatably supported in corresponding bearings 152A, 152B. The pinion 151 is fixed to the spindle 15 approximately in the middle between the two side panels 111A, 111B and divides the spindle 15 in two portions 150A, 150B, wherein both portions 150A, 150B have an outer thread 153A, 153B on at least parts of their surfaces with the outer threads 153A, 153B being of opposite sense of rotation, i.e. helicity.

On each side of the pinion 151 a spindle nut 16A, 16B each having an inner thread 162A, 162B (not visible in the figures) engaging the outer thread 153A, 153B of the respective portion 150A, 150B of the spindle 15 is mounted. The spindle nuts 16A, 16B each have an upper recess 160A, 160B and a lower recess 161A, 161B serving as a guide means for a guide fork 13A, 13B. Each guide fork 13A, 13B engages with the upper recess 160A, 160B and the lower recess 161A, 161B of the respective spindle nut 16A, 16B with an upper portion 130A, 130B and a lower portion 131A, 131B. By this engagement each guide fork 13A, 13B prevents a rotation of the respective spindle nut 16A, 16B. Hence, when the spindle 15 is being rotated, the two spindle nuts 16A, 16B travel along the spindle 15 in opposite direction. By the engagement with the corresponding spindle nuts 16A, 16B the guide forks 13A, 13B are carried along the spindle 15 together with the spindle nuts 16A, 16B. The spindle 15 extends along a second spatial axis X which is substantially vertical with respect to a first spatial axis Y, the first spatial axis Y being substantially perpendicular to the plane of the door panels 20A, 20B.

The guide forks 13A, 13B serve for driving the door panels 20A, 20B from an opened state into a closed state and vice versa, depending on the sense of rotation of the spindle 15, as will be described with reference to the following figures.

The rod 19 may be rotated by the drive motor 14 by means of the pinions 141, 190. The rod 19 extends between supports 114A, 114B fixed to the top panel 110 close to the side panels 111A, 111B. Adjacent to each of its supports 114A, 114B the rod 19 is fixedly connected to an eccentric 191A, 191B being pivotably connected to an end of a lever 172A, 172B via a hinge joint 173A, 173B, wherein said hinge joint 173A, 173B is arranged radially spaced from the rod 19. The other end of the lever 172A, 172B is pivotably connected with a bearing 175A, 175B fixed to a carrier 171A, 171B via another hinge joint 174A, 174B. A rotation of the rod 19 thus urges the carriers 171A, 171B each one being guided on a pair of guide means 113A, 113B on the side panels 111A, 111B to move along the first spatial axis Y. Each guide means 113A, 113B may be designed e.g. as a roller guiding, a linear guiding or a recirculating ball bearing guide. The direction of the movement of the carriers 171A, 171B along the first spatial axis Y depends on the sense of rotation of the rod 19.

The carriers 171A, 171B are fixed on opposite ends of a guide rail 17 which is therefore moved along the first spatial axis Y together with the carriers 171A, 171B. The guide rail 17 serves for slidably supporting the door panels 20A, 20Bas will be described with reference to the following figures.

The drive motor 14 may be configured such that in the closed state at the beginning of an opening procedure first the rod 19 is rotated for shifting the carriers 171A, 171B and the guide rail 17 outwards along the first spatial axis Y and afterwards the spindle 15 is rotated for driving the guide forks 13A, 13B along the second spatial axis X in opposite orientation. The drive motor 14 may also be configured such that these two movements are at least partly superimposed and thus are at least partly executed simultaneously. To perform said operations the drive motor may comprise a suitable gearing and may itself at least partially be rotatable.

In the closed state of the door 2, as shown in FIG. 2, the door panels 20A, 20B may flush with the surface of the wagon body 31 and therefore be located inside a wall of the wagon 3 which is not shown in FIG. 2.

Figure 3:
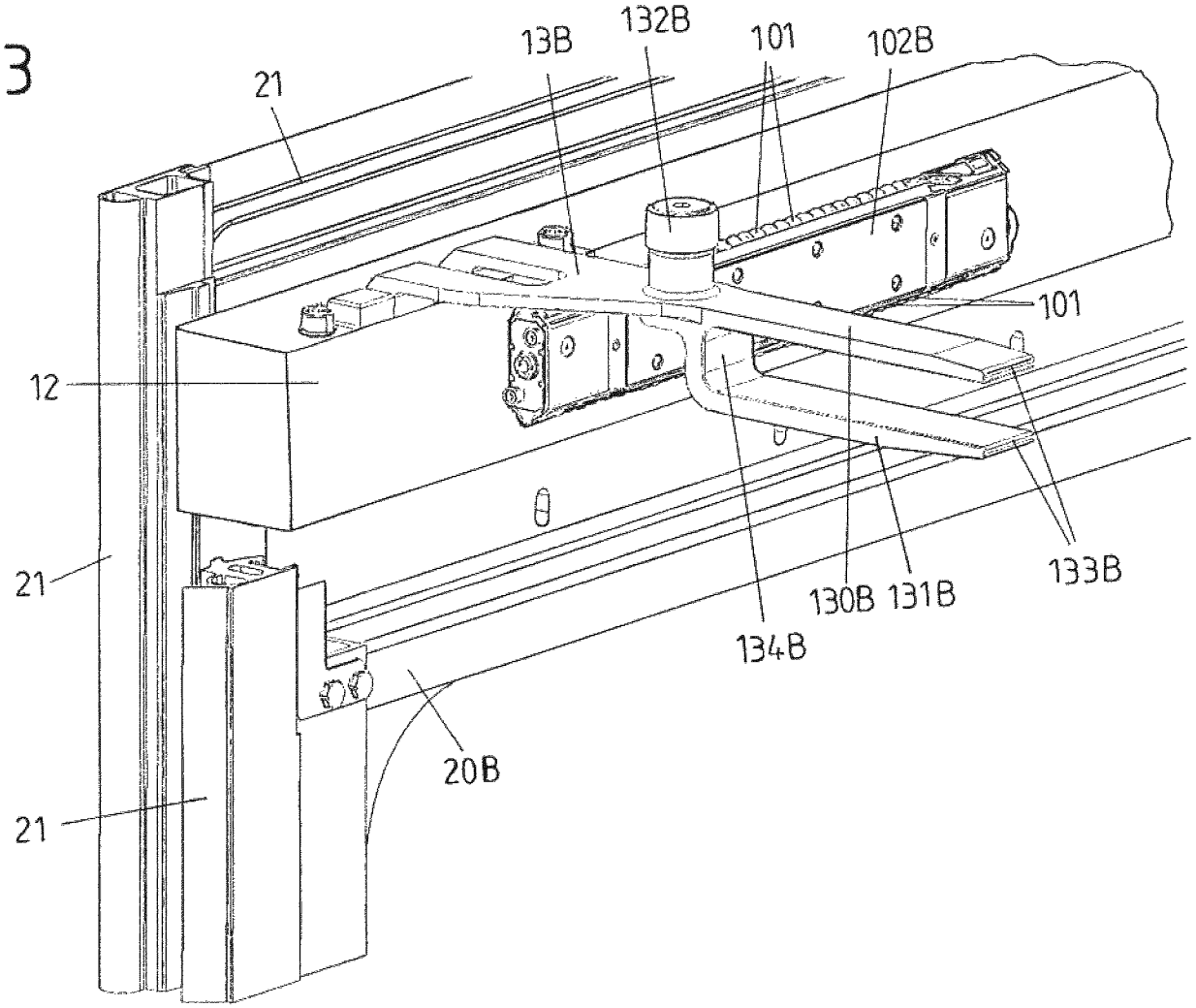
FIG. 3 shows a part of a door panel mounted on a door panel mount to which a guide fork is attached.

FIG. 3 shows an upper edge of the door panel 20B mounted on an associated door panel mount 12, to which an associated guide fork 13B is fixed. A roller carrier 102B is mounted on the opposite side of the door panel mount 12 with respect to the door panel 20B. This roller carrier 102B comprising a plurality of rollers 101 may be engaged with the guide rail 17 for a slidable connection therewith.

The guide fork 13B has an upper portion 130B and a lower portion 131B having surfaces facing each other extending parallel to one another. The upper portion 130B and the lower portion 131B end with tips 133B. Alternatively, instead of having tips 133B at their ends, the upper and lower portions 130B 131B may also be connected with each other by a vertical portion. The ends of the upper and lower portions 130B, 131B facing away from the tips 133B are connected with each other, forming a rear stop 134B on the guide fork 13B. Close to the rear stop 134B, the guide fork 13B further comprises a roll 132B which may be brought in contact with a stop bar not shown in FIG. 3 but described below with reference to FIG. 5.

The door panel 20B may be opened and closed by driving the guide fork 13B along the second spatial axis X by means of the spindle nut 16B as shown in FIG. 2. A displacement of the spindle nut 16B over a given distance along the spindle 15 results in a displacement of the door panel 20B of substantially the same distance.

The door panel 20B is provided with several rubber seals 21 for a tight closure with another door panel 20A and a frame 22 (both not shown in FIG. 3) of the door 2.

E.g. for compensating production tolerances of parts of the door 2 or the door drive device 1, the guide fork 13B may be adjustable with respect to its position on the door panel mount 12 and/or its angle relative to said door panel mount. Moreover, the guide fork 13B may be pivotably connected with the door panel mount 12, in particular about a pivot axis being substantially parallel to the second spatial axis X.

Figure 4:
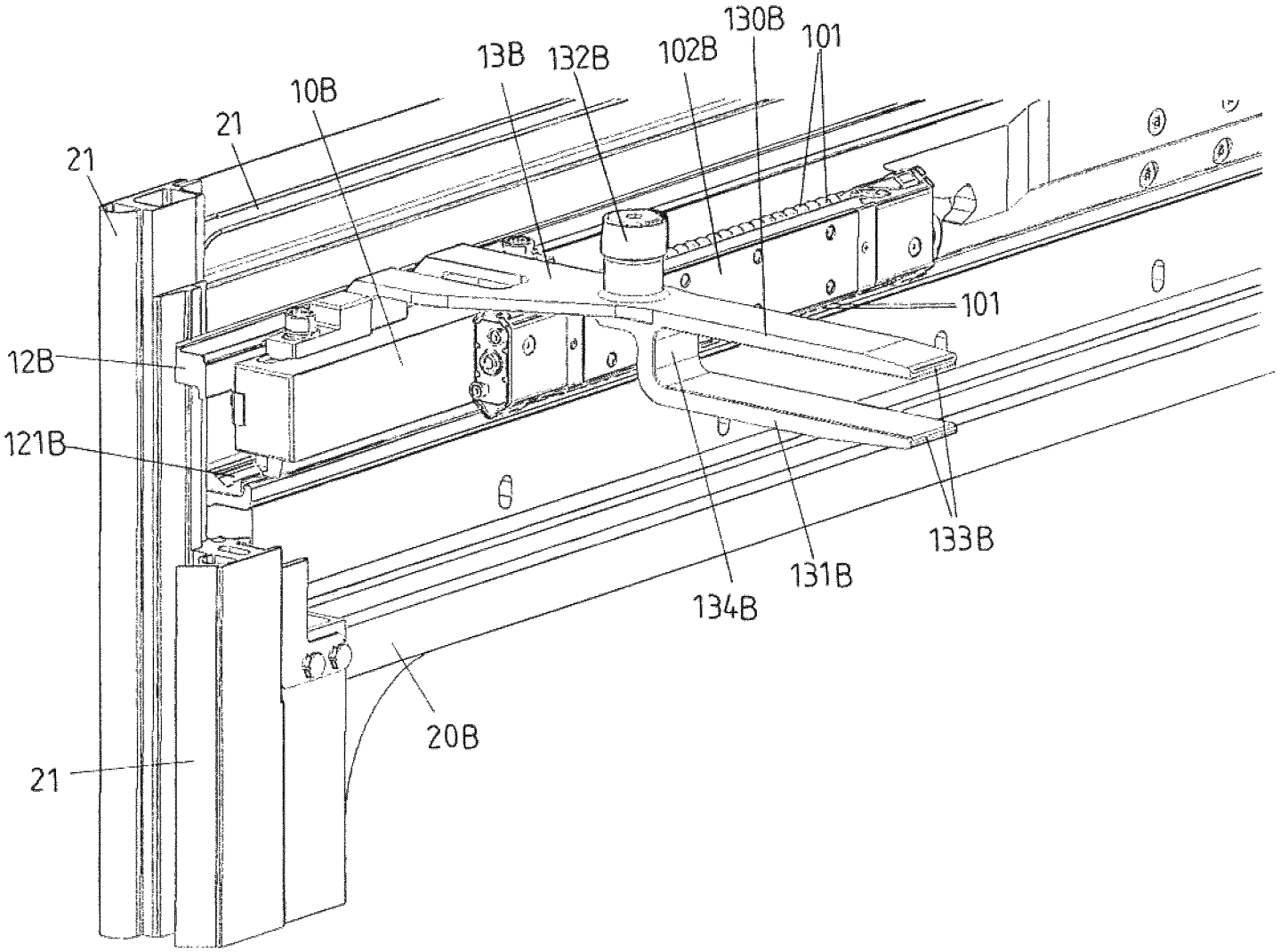
FIG. 4 shows the part of a door panel of FIG. 3 being slidably attached to a drive carriage to which a guide fork is attached.

FIG. 4 shows the upper edge of the door panel 20B according to FIG. 3; however, in FIG. 4 the door panel 20B is mounted on a different embodiment of a door panel mount 12B, which is connected to an associated drive carriage 10B, wherein the associated guide fork 13B is fixed on said drive carriage 10B.

The drive carriage 10B is connected to the door panel mount 12B by means of a linear roller bearing. Moreover, the drive carriage 10B is to be connected to the guide rail 17 which is not shown in FIG. 4 also by means of a linear roller bearing. Therefore, the drive carriage 10B comprises two roller carriers 102B on opposing sides carrying a plurality of rollers 101. One of the roller carriers 102B is visible in FIG. 4 while the other is hidden behind the drive carriage 10B and standing in engagement with a corresponding guiding 121B of the door panel mount 12B. Both for the connection of the door panel mount 12B to the drive carriage 10B and for the connection of the drive carriage 10B to the guide rail 17, also recirculating ball bearing guides or other types of guiding devices may be used.

The guide fork 13B is driven by the associated spindle nut 16B (not shown in FIG. 4) resulting in a relative displacement between the guide rail 17 and the drive carriage 10B. A relative displacement between the drive carriage 10B and the door panel mount 12B may be effected by any suitable mechanism (not shown in FIG. 4). As an example for such a mechanism, at least one pinion may be rotatably mounted on the drive carriage 10B and engaged with a first gear rack mounted on the door panel mount 12B, wherein the first gear rack extends substantially along the second spatial axis X (along the axis of the relative displacement of the drive carriage 10B and the door panel mount 12B). When the roller carrier 102B is in engagement with a corresponding guiding of the guide rail 17, the pinion may then also be engaged with a second gear rack mounted on the guide rail 17, which second gear rack extends substantially in parallel to the first gear rack. Alternatively, the pinion may only be directly engaged with one of the two gear racks and be operatively connected with the other one of the two gear racks via one, two or more further pinions, the pinions having the same or, alternatively, a different number of teeth. Moreover, the two racks of course may also be operatively connected via more than one pinion (or group of connected pinions) in parallel. A relative displacement between the drive carriage 10B and the guide rail 17 along the second spatial axis X therefore causes a relative displacement between the drive carriage 10B and the door panel mount 12B in the same direction by means of the pinion resulting in a relative displacement between door panel mount 12B and the guide rail 17 over a distance corresponding to the sum of the two separate displacement components.

As the guide fork 13B being mounted to the embodiment of the door panel mount 12 according to FIG. 3, the guide fork 13B may also be pivotably connected with the drive carriage 10B according to FIG. 4 or adjustably mounted therewith.

The above description with reference to FIGS. 3 and 4 each is related to one door panel 20B of the two door panels 20A, 20B shown in FIGS. 1 and 2. Nevertheless, this description is likewise applicable to the other one door panel 20A of said two door panels 20A, 20B as well as for the corresponding other parts of the door drive device 1.

Figure 5:
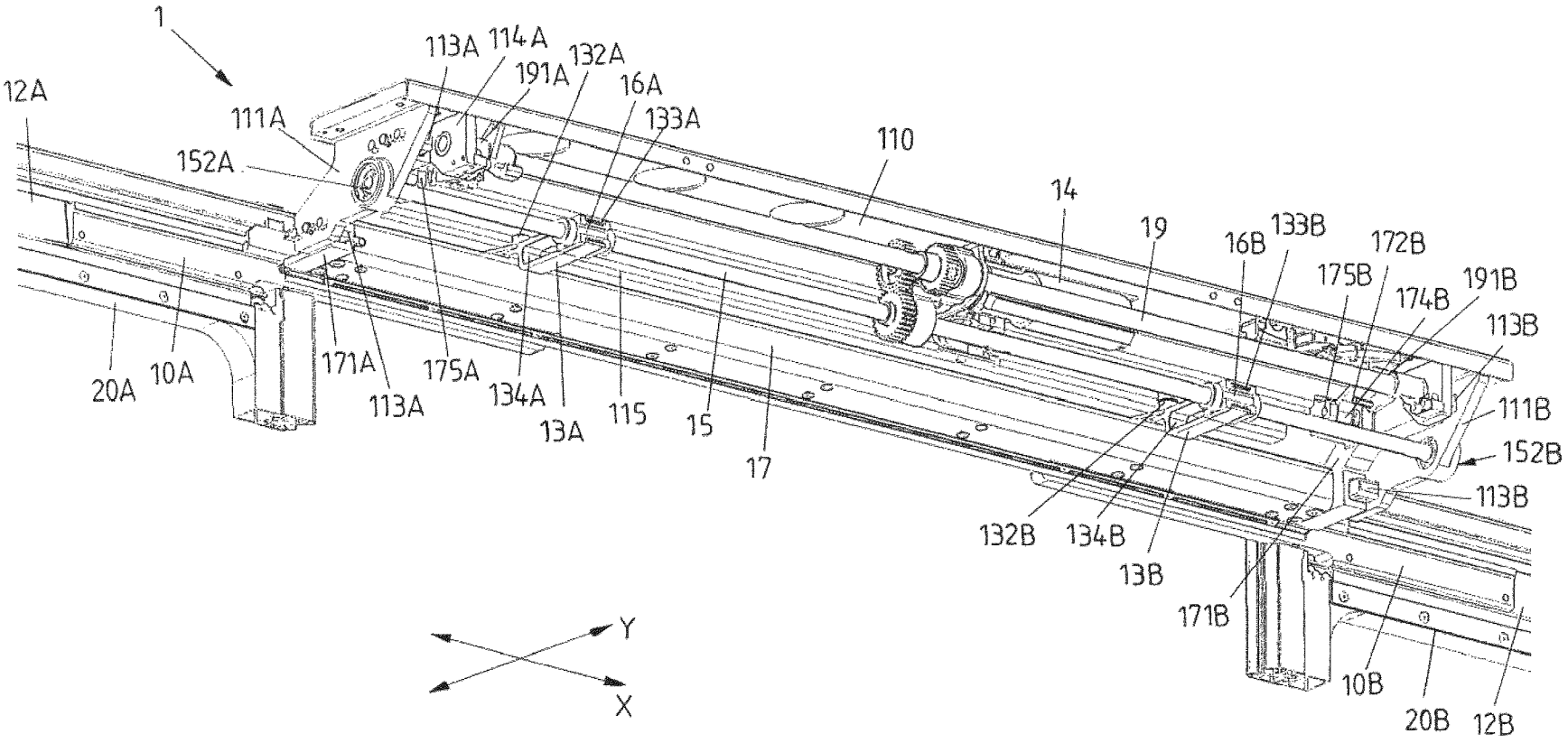
FIG. 5 shows the door drive device of FIG. 2 together with upper parts of two door panels connected with the door drive device in an opened state.

FIG. 5 shows the door drive device 1 shown in FIG. 2 in an opened state of the door 2 together with upper parts of the two door panels 20A, 20B connected with door panel mounts 12A, 12B of the door drive device 1, wherein the door panel mounts 12A, 12B are connected to the guide rail 17 via drive carriages 10A, 10B corresponding to the drive carriage 10B according to FIG. 4. As compared to FIG. 2, the guide rail 17 with its carriers 171A, 171B is displaced along the first spatial axis Y in outward direction, i.e. towards the outside of the vehicle 3 from a retracted position as seen in FIG. 2 into an extended position by means of the drive motor 14. Since the drive carriages 10A, 10B are slidably supported on the guide rail 17 also those are situated in the extended position in FIG. 5. The latter also applies for door panel mounts 12A, 12B which are slidably supported on the drive carriages 10A, 10B as well as for the guide forks 13A, 13B which are fixed to the drive carriages 10A, 10B.

When comparing the positions of the guide forks 13A, 13B in the closed state of the door 2 as shown in FIG. 2 with their positions in the opened state of the door 2 as shown in FIG. 5 it can be seen that both guide forks 13A, 13B have been displaced over the same distance and in the same direction along the first spatial axis Y as well as over the same distance and in opposite directions along the second spatial axis X. While in the closed state of the door 2 the spindle nuts 16A, 16B are located close to the rear stops 134A, 134B of the guide forks 13A, 13B, they are located close to the tips 133A, 133B of the guide forks 13A, 13B in the opened state of the door 2. Thus, the design of the guide forks 13A, 13B allows the guide forks 13A, 13B to be displaced along the first spatial axis Y maintaining the engagement with the spindle nuts 16A, 16B even though the latter may not be displaced along the first spatial axis Y with the spindle 15 being rotatably fixed with respect to the support frame 11 and thus with respect to the vehicle 3.

The upper portions 130A, 130B and the lower portions 131A, 131B of the guide forks 13A, 13B, which serve as guides for the corresponding spindle nuts 16A, 16B, have an elongate form extending along the first spatial axis Y. The upper portions 130A, 130B and the lower portions 131A, 131B of the guide forks 13A, 13B are long enough to be moved from a retracted position to an extended position (referring to the first spatial axis Y) without disengaging from the spindle nuts 16A, 16B. From the closed to the opened state of the door 2 the guide forks 13A, 13B are displaced along the second spatial axis X by a given distance. This displacement results in a displacement of the door panel mounts 12A, 12B in the same direction and of the double of said distance. Due to this arrangement the spindle 15 does not necessarily have to be of the same length as the required width of the door opening between the door panels 20A, 20B. Therefore the total installation space required for the door drive device 1 may be reduced with respect to the prior art.

As can be seen in FIG. 5, the guide forks 13A, 13B further comprise rolls 132A, 132B which are in contact with a stop bar 115 extending between the side panels 111A, 111B when the guide forks 13A, 13B are in an extended position. When the guide forks 13A, 13B are being displaced along the second spatial axis X the rolls 132A, 132B may roll off on the stop bar 115.

It will be understood that a door 2 may particularly comprise either one or two door panels 20A, 20B. The above description has been given for a door 2 with two door panels 20A, 20B but is likewise applicable for doors with only one door panel 20A, 20B. It will also be understood that while the exemplary door panels 20A, 20B shown in the figures have a substantially flat outer surface, the above description also applies for door panels which may have a bent or curved form and/or have kinks or other shapes.

LIST OF REFERENCE NUMERALS

1 door drive device
10A, 10B drive carriage
101 rollers
102A, 102B roller carrier
11 support frame
110 top panel
111A, 111B side panel
112 cover
113A, 113B guide means
114A, 114B support
115 stop bar
12, 12A, 12B door panel mount
121A, 121B guiding
13A, 13B guide fork
130A, 130B upper portion
131A, 131B lower portion
132A, 132B roll
133A, 133B tip
134A, 134B rear stop
14 drive motor
140 pinion
141 pinion
15 spindle
150A, 150B portion
151 pinion
152A, 152B bearing
153A, 153B outer thread
16A, 16B spindle nut
160A, 160B upper recess
161A, 161B lower recess
162A, 162B inner thread
17 guide rail
171A, 171B carrier
172A, 172B lever
173A, 173B hinge joint
174A, 174B hinge joint
175A, 175B bearing
19 rod
190 pinion
191A, 191B eccentric
2 door
20A, 20B door panel
21 rubber seal
22 frame
3 wagon
31 wagon body
32 wagon window
X second spatial axis
Y first spatial axis

The invention claimed is:

1. A door drive device for a door of a vehicle, comprising:

at least one door panel mount displaceable along a first spatial axis substantially perpendicular to a plane of a door panel mounted on the at least one door panel mount and along a second spatial axis extending substantially horizontal in use and substantially perpendicular to the first spatial axis;

a drive motor; and a spindle configured to be rotated by means of the drive motor, wherein a displacement of the at least one door panel mount along the first spatial axis, the second spatial axis, or both the first and second spatial axes is effected by means of a guide fork being displaceable by an associated spindle nut slidably engaged with the guide fork, wherein the spindle nut is driven by rotation of the spindle and wherein the spindle and the drive motor are mounted to the vehicle, and the door panel is displaceable along the first spatial axis from a retracted position to an extended position, and the guide fork is configured to be displaceable with respect to the spindle nut along the first spatial axis from the retracted position to the extended position without disengaging from the spindle nut.

2. The door drive device according to claim 1, wherein the guide fork is attached to the at least one door panel mount.

3. The door drive device according to claim 2, wherein the door drive device comprises each two door panel mounts, drive carriages, guide forks and spindle nuts, which are displaceable in the second spatial axis simultaneously but in opposite directions.

4. The door drive device according to claim 2, wherein the at least one guide fork is pivotably mounted.

5. The door drive device according to claim 1, wherein the at least one door panel mount is slidably attached to an associated drive carriage slidably attached to a guide rail, wherein a relative displacement between the drive carriage and the guide rail along the second spatial axis causes a relative displacement between the drive carriage and the door panel mount substantially in the same direction, wherein the guide fork is attached to the drive carriage.

6. The door drive device according to claim 5, wherein at least one pinion is rotatable on the at least one drive carriage and engages a gear rack of the guide rail and a gear rack of the door panel mount associated to the at least one drive carriage.

7. The door drive device according to claim 6, wherein a displacement of the at least one guide fork in a direction along the second spatial axis results in a displacement of the associated door panel mount in substantially the same direction along the second spatial axis as the displacement of the at least one guide fork, and wherein a distance of the displacement of the associated door panel mount is substantially twice a distance of the displacement of the at least one guide fork.

8. The door drive device according to claim 5, wherein a displacement of the at least one guide fork in a direction along the second spatial axis results in a displacement of the associated door panel mount in substantially the same direction along the second spatial axis as the displacement of the at least one guide fork, and wherein a distance of the displacement of the associated door panel mount is substantially twice a distance of the displacement of the at least one guide fork.

9. The door drive device according to claim 5, wherein the guide rail is guided along the first spatial axis by guiding means designed as roller guiding, linear guiding or recirculating ball bearing guide.

10. The door drive device according to claim 5, wherein the at least one door panel mount is displaceable along the first spatial axis by displacing the guide rail along the first spatial axis.

11. The door drive device according to claim 5, wherein the door drive device comprises each two door panel mounts, drive carriages, guide forks and spindle nuts, which are displaceable in the second spatial axis simultaneously but in opposite directions.

12. The door drive device according to claim 5, wherein the at least one guide fork is pivotably mounted.

13. The door drive device according to claim 1, wherein the door drive device comprises each two door panel mounts, drive carriages, guide forks and spindle nuts, which are displaceable in the second spatial axis simultaneously but in opposite directions.

14. The door drive device according to claim 1, wherein the at least one guide fork has an elongate upper portion slidably engaging in an upper recess of the associated spindle nut and an elongate lower portion slidably engaging in a lower recess of the associated spindle nut, wherein the upper portion and the lower portion are only connected with one another on one side of the spindle nut.

15. The door drive device according to claim 14, wherein the upper and lower portions of the at least one guide fork are arranged substantially perpendicular to the spindle.

16. The door drive device according to claim 1, wherein a displacement of the at least one door panel mount along the first spatial axis is at least partially effected by means of the guide fork.

17. The door drive device according to claim 1, wherein the at least one guide fork is displaceable with respect to the associated spindle nut along the first spatial axis.

18. A door comprising:

a door drive device according to claim 1; and at least one door panel.

19. A vehicle comprising at least one door, said at least one door comprising:

at least one door panel mount displaceable along a first spatial axis substantially perpendicular to a plane of a door panel mounted on the at least one door panel mount and along a second spatial axis extending substantially horizontal in use and substantially perpendicular to the first spatial axis, a drive motor; and a spindle configured to be rotated by means of the drive motor, wherein:

a displacement of the at least one door panel mount along the first spatial axis, the second spatial axis, or both the first and second spatial axes is effected by means of a guide fork being displaceable by an associated spindle nut slidably engaged with the guide fork, wherein the spindle nut is driven by rotation of the spindle and wherein the spindle and the drive motor are mounted to the vehicle;

the at least one guide fork has an elongate upper portion slidably engaging in an upper recess of the associated spindle nut and an elongate lower portion slidably engaging in a lower recess of the associated spindle nut, wherein the upper portion and the lower portion are only connected with one another on one side of the spindle nut;

wherein the upper and lower portions of the at least one guide fork are arranged substantially perpendicular to the spindle; and the door panel is displaceable along the first spatial axis from a retracted position to an extended position, and the guide fork is configured to be displaceable with respect to the spindle nut along the first spatial axis from the retracted position to the extended position without disengaging from the spindle nut.

* * * * *